US006354404B1

(12) United States Patent
Sansevero et al.

(10) Patent No.: US 6,354,404 B1
(45) Date of Patent: Mar. 12, 2002

(54) ROTATABLE ELEVATOR SYSTEM

(75) Inventors: Frank Sansevero, Glastonbury, CT (US); Gordon D. Row, Groton, MA (US); Gregg Draudt; Jared Judson, both of Cambridge, MA (US); Daniel E. Rush, Canton, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/571,820

(22) Filed: May 16, 2000

(51) Int. Cl.[7] ..... B66B 9/00
(52) U.S. Cl. ..... 187/249
(58) Field of Search ..... 187/249, 406, 187/414; 198/328; 414/263

(56) References Cited

U.S. PATENT DOCUMENTS

| | | | | | |
|---|---|---|---|---|---|
| 723,325 | A | * | 3/1903 | Soulder | 198/328 |
| 2,677,451 | A | * | 5/1954 | Normandeau | 198/328 |
| 2,756,686 | A | * | 7/1956 | Kendall et al. | 104/25 |
| 3,395,648 | A | * | 8/1968 | Karr et al. | 198/328 |
| 3,474,918 | A | * | 10/1969 | Postmes et al. | 414/263 |
| 3,896,736 | A | * | 7/1975 | Hamy | 104/88 |
| 4,946,006 | A | * | 8/1990 | Kume | 187/249 |
| 5,158,167 | A | * | 10/1992 | Pahl | 198/328 |
| 5,165,513 | A | * | 11/1992 | Nakatani | 198/328 |
| 5,197,570 | A | * | 3/1993 | Matsui | 187/249 |
| 5,213,191 | A | * | 5/1993 | Tahara et al. | 198/328 |

FOREIGN PATENT DOCUMENTS

| | | | |
|---|---|---|---|
| JP | 11-79568 | * | 3/1999 |

* cited by examiner

*Primary Examiner*—Thomas J. Brahan

(57) ABSTRACT

A rotating passenger conveying system includes a central rotating column which drives a number of cabs to rotate about an axis. The cabs are also movable along the axis between a first and second floor. The central column rotates continuously, and the cabs are cyclically moved between the two floors. Passengers can enter a cab at one of the floors, and cab will then rotate to a movement zone. In the movement zone the cab will move to the other floor. The movement and flow of passengers in this system is continuous, and thus, the throughput of passengers in the rotating passenger conveying system is closer to an escalator system than to an elevator.

15 Claims, 3 Drawing Sheets

ROTATABLE ELEVATOR SYSTEM

BACKGROUND OF THE INVENTION

This invention relates to an elevator-like passenger conveying system that approximates the passenger flow characteristics of an escalator.

Typically, passengers are moved between the floors in low rise buildings such as malls, etc., by escalators. Escalators are widely utilized in most malls, as they are perceived to be a quicker means of traveling between floors. Most malls also incorporate a few elevators, however, the elevators are not used as frequently as escalators. It is believed that elevators are not used because passengers do not like the wait and travel time between the floors Statistics show that an average escalator moves a much higher number of passengers than an elevator in such locations. However, escalators do have down sides. As one example, escalators do not move strollers, wheelchairs, etc. as easily as do elevators.

The assignee of the present application has developed a piston-type passenger conveying system. In this system, a set of at least three cabs is utilized to move the passengers between the two floors. A cab is waiting at each floor at most times. Another cab is moving between the floors at most times. The above system is disclosed in co-pending U.S. patent application Ser. No. 09/571,769, filed on even date herewith, and entitled "Piston-Type Passenger Conveying System".

This passenger-conveying system provides the benefits of both an escalator and an elevator. The basic movement technology is elevator-like and thus, the downsides of escalators are avoided. However, passenger flow is continuous and thus, a higher number of passengers can move between the floors.

The present invention is a unique method of moving passengers continuously with elevator-type technology.

SUMMARY OF THE INVENTION

In a disclosed embodiment of this invention, a rotating central column carries at least three cabs. There are preferably at least four cabs, and more preferably at least six cabs, which rotate with the central column. Each of the cabs can move between two floors along the column, and all of the cabs rotate with the column. The column is driven to rotate. Cabs are at each of the floors at most times such that passengers wishing to travel between the floors can simply walk up and onto a cab at all times at each floor. The cab continues to rotate to a transfer section, at which time the cab moves between the two floors and along the column. During this movement it preferably continues to rotate with the column. The movement of the cabs along the column is preferably achieved by grouping the cabs into opposed pairs. A single machine is preferably utilized to drive the two cabs in each pair between the two floors.

These and the other features of the present invention will be best understood from the following specification and drawings, the following of which is a brief description.

DETAILED DESCRIPTION OF A PREFERRED EMBODIMENT

Figure 1:
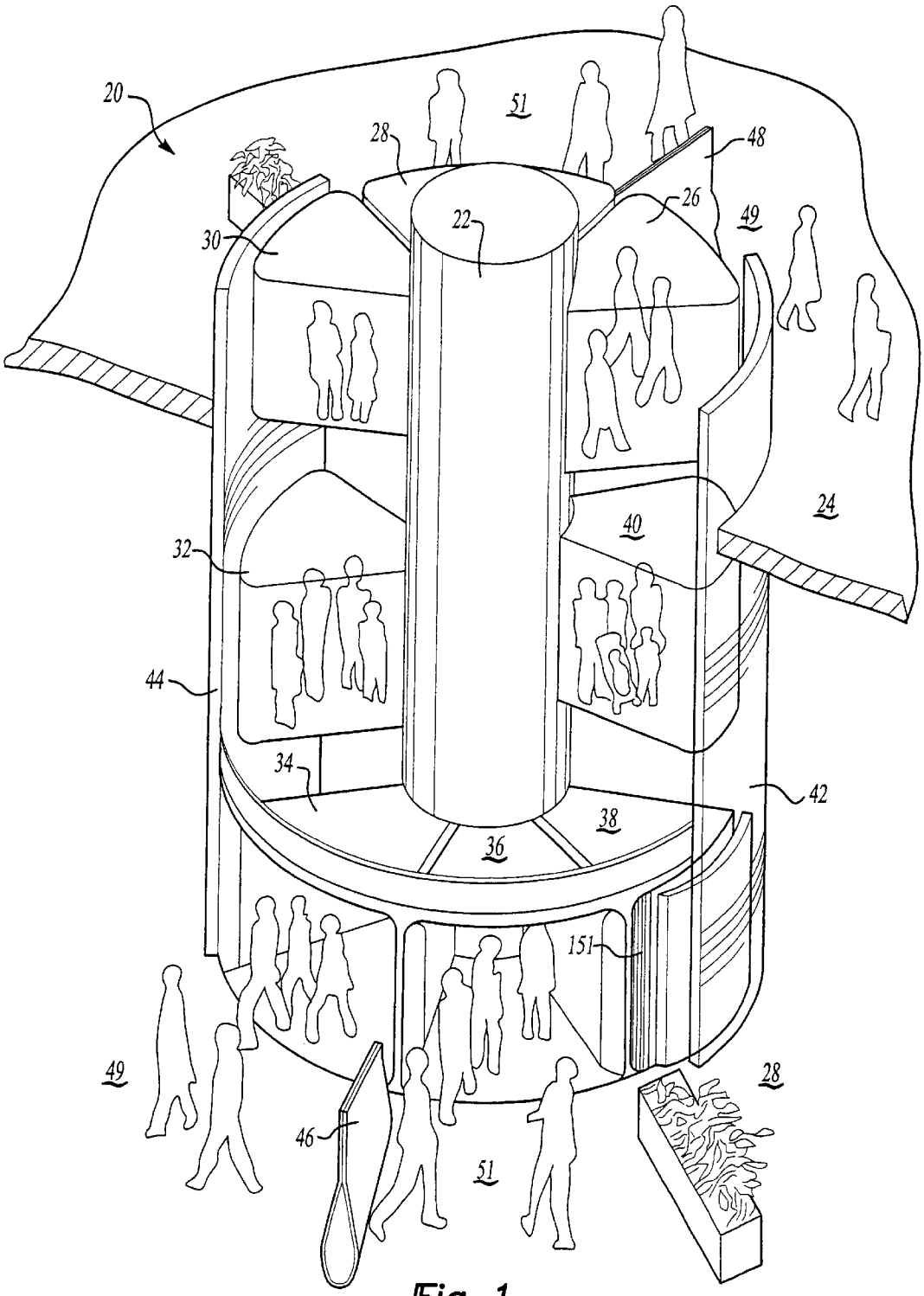
FIG. 1 is a perspective view of a rotating passenger conveying system.

A rotating passenger conveying system 20 is illustrated schematically in FIG. 1, having a central column 22 which is driven to rotate. Passengers are moved between floors 24 and 25 by cabs 26, 28, 30, 32, 34, 36, 38 and 40. Although eight cabs are illustrated, to reduce costs only six cabs would be used in a preferred embodiment, as explained below. Although it is preferred that at least six cabs are utilized, lesser numbers of cabs can be utilized. It is most desirable that there be at least four cabs with a single cab at each of the floors 24 and 25, and at least one cab moving to each of the floors.

As shown, an enclosure 42 and an enclosure 44 encloses cabs 30, 32, 38 and 40. These are the cabs moving between the floors. It is preferred that the enclosures 42 and 44 be transparent such that a passenger will be able to see the surrounding stores if the system is in a mall. As can be seen, the cabs each include side walls, a ceiling and a floor. Thus, the cabs are enclosed, as in the sense of an elevator. Moreover, as can be appreciated from this figure, the cabs move in a cycle of operation as they rotate with column 22 such that on each rotational cycle the cabs spend a period of time moving horizontally at one floor, move vertically to the other floor, move horizontally without any vertical component at that other floor, and then return vertically to the first floor. All of this movement occurs within a single cycle of rotation with the column 22. As can further be appreciated from the various figures in this application, the cabs do move axially along the column and can move axially relative to each other.

Dividers 46 and 48 may be utilized to divide a loading zone from an exit zone at each floor. Thus, the cab 26 having reached the floor 24 is now in an exit zone 49 with passengers exiting. The cab 28 having passed the divider 48 may be in a loading zone 51 with passengers loading into the cab 28. The column 22 continues to rotate with each cab moving between sequential stations. The cab 30 has now moved to a position wherein the enclosure 44 prevents passengers from leaving or entering the cab. More preferably, cab doors would be closed at this point preventing passenger movement. The cab 32 is at the next step in the movement, and is being moved downwardly. Cab 34 has recently arrived at the floor 25, and has rotated into an exit zone 49 defined by the divider 46. The cab 36, having continued to rotate from the cab 34 position is now in an entrance zone 51, again defined by the divider 46. The cab 38 is in a position to begin movement back to the floor 24, and the cab 40 is moving toward the floor 24 and will soon rotate to the position now occupied by cab 26. The movement is continuous, and a greater number of passengers will be transported between the floors 24 and 25 than with a typical elevator system.

As the preferred embodiment only six cabs are necessary. The stations where cabs 30 and 32 are now shown are combined into a single cab. Similarly, the cabs 38 and 40 are only a single cab at any one time. Thus, the cab moves into the position occupied by cab 38 and moves upwardly as shown by cab 40 and then moves to the position occupied by the cab 26. The difference between six and eight cabs go to cost and size differences. Thus, eight cabs are also a beneficial arrangement.

A safety buffer 151, which may be a relatively flexible device with known sensors is positioned adjacent the end of the position where cab 36 is turning to the position of cab 38. A similar safety buffer may be positioned adjacent to the beginning of the enclosure 44, as cab 28 is turning toward the cab 30 position. The safety buffers 151 will sense the presence of a passenger being caught between the entrance to a cab 36 and the enclosure 42, and stop operation of the central column 22 should a passenger be trapped. Further, while cab doors are not shown, cab doors will preferably close as the cabs rotate from the passenger loading position 36 towards the position of 38, and from the position 28 toward the position 30. Those same cab doors will open as the cabs move into the exit positions 26 and 34. The cab door technology may be as known, and thus is not disclosed here.

Figure 2:
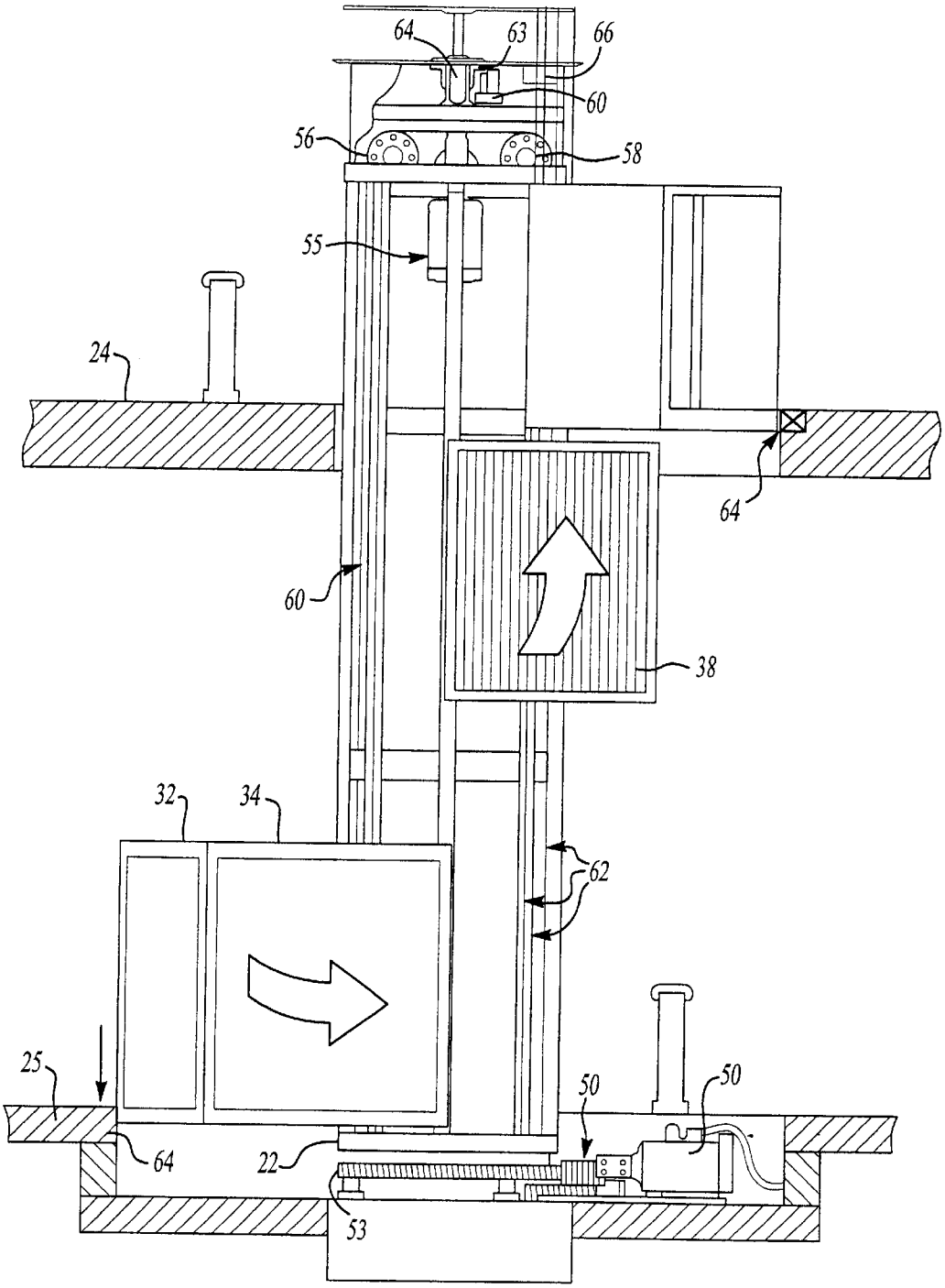
FIG. 2 is a cross sectional view through the basic drive components of the FIG. 1 system.

FIG. 2 schematically shows the drive motors for the invention illustrated in FIG. 1. As can be seen, a motor 52 drives a gear toothed section 53 on the column 22 through a gear train 50. The column 22 rotates, and the cabs move with the rotating column.

A machine 55 is shown which drives cables around pulleys 56 and 58, to move the cabs between upper and lower positions. It should be understood that there are four pairs of cabs, and that each pair of cabs has a separate machine. A rope 60 is shown moving over sheaves 56 and 58. The machine 55 is driving the cab 38 upwardly in the illustrated position. The illustrated machine 55 is not associated with the sheaves 56 and 58, but rather with a distinct pair. A mount bearing 63 mounts a spindle 64 from the column 22. An electrical supply 66 communicates through power slip rings 60. The details of the supply of electrical energy through the rotating column are shown schematically, and may be as known, and form no separate portion of this invention.

Guide rails 62 extend along the column. There are preferably two rails for each cab. A docking ring 64 provides a seal between the floor 25 and 24 and the cabs, once the cabs have arrived at the particular floors.

Figure 3:
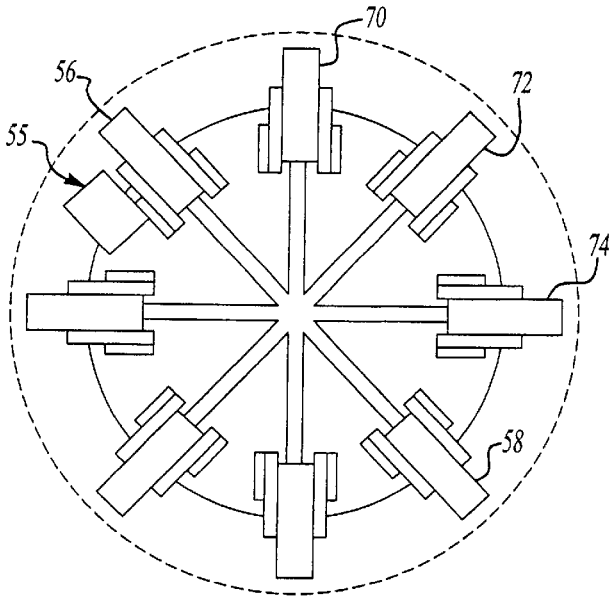
FIG. 3 is a plan view of the machines arranged around a central core in the present invention.

FIG. 3 shows details of a preferred method of accomplishing the basic arrangement as described above. As shown, sheaves 56 and 58 receive rope 60. A motor 55 is shown associated with rope 60. Other sets 70, 72 and 74 of ropes and sheaves are shown spaced circumferentially from the first set. Each of these sets is provided with a machine 55, although only one is shown.

Figure 4:
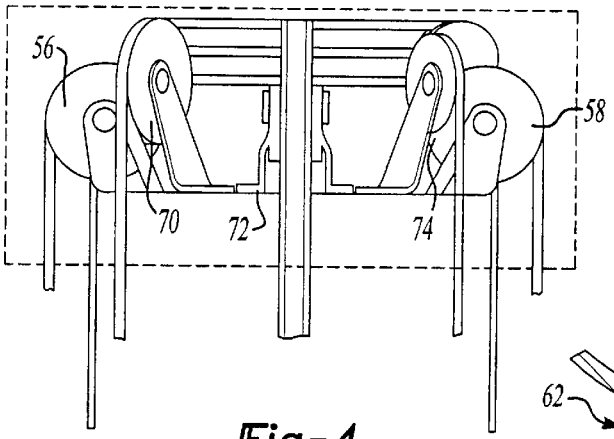
FIG. 4 shows a side view of the FIG. 3 details.

As shown in FIG. 4, the ropes associated with each of the sheave sets may be at different vertical positions. As can be appreciated from FIG. 3, the ropes generally cross across the center of the column 22. Thus, by having them at distinct vertical positions, the ropes can cross the column and still be packaged within a relatively small space. The single rope drives the two cabs with each other. The cabs provide counterweight for each other.

Figure 5:
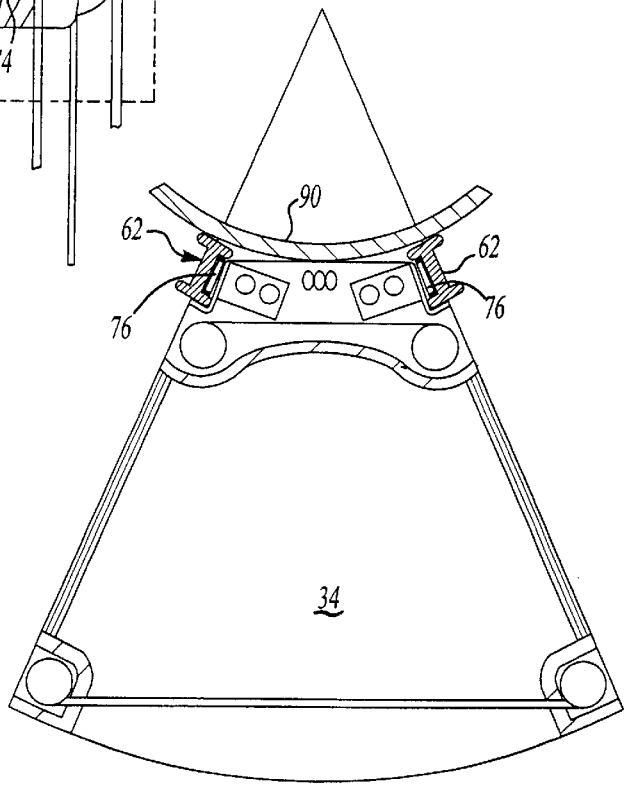
FIG. 5 shows the mounting of a cab.

FIG. 5 shows the mounting of a cab 34. As shown, guide rails 62 extend along the length of the column 22, and rotate with the column 22. These guide rails receive rollers 76 which are mounted on the cab 34. Thus, the cab 34 is guided for movement along the guide paths. An outer wall 90 of the column supports the guide rails.

Although the particular illustrated embodiment has eight cabs, it should be understood that the basic goals of this invention could be achieved with as few as three cabs. Most preferably, at least four cabs are utilized with one being at each floor and one moving to each floor at all times. For purposes of this application, the movement of the cabs will be described as a cab being at each floor and moving to the floor most of the time. It may be that the control of the cab is such that occasionally there could be a floor without a cab for a short time. This is particularly true if a three cab system is utilized. The most preferred embodiment is that having six cabs such as explained above. With such an embodiment, there will always be a cab at each floor.

A preferred embodiment of this invention has been disclosed, however, a worker in this art would recognize that certain modifications would come within the scope of this invention. For that reason the following claims should be studied to determine the true scope and content of this invention.

What is claimed is:

1. A rotating passenger conveying system comprising:

a central column rotating about a vertical axis, and extending between at least first and second floors;

at least three enclosed cabs which rotate with said central column, said cabs being axially moveable along said axis and relative to said column between the first and second floors, and the arrangement of the cabs being such that at least one of said cabs is at each of the floors the majority of time, and at least another of said cabs is moving to one of the floors; and wherein a cycle of said cab movement being defined by said cab rotating once with said central column, and moving axially from said first floor to said second floor and then from said second floor to said first floor, all within one rotational cycle of said central column and said cabs.

2. The system as set forth in claim 1, wherein there are at least four of said cabs.

3. The system as set forth in claim 2, wherein there are at least six of said cabs, with at least two of said cabs being at each of said floors at all times.

4. The system as set forth in claim 2, wherein said at least four cabs are paired into groups of two cabs, with each set of said two cabs being driven by an associated rope to move with each other.

5. The system as set forth in claim 4, wherein a single machine is used to drive each said rope and move said two cabs in each of said pairs.

6. The system as set forth in claim 4, wherein said rope associated with each of said pairs is positioned at different vertical heights relative to the other ropes such that each rope crosses across a width of said column without interference from the other ropes.

7. The system as set forth in claim 1, wherein a divider is associated with each of the floors to define a cab entrance section and a cab exit section.

8. The system as set forth in claim 1, wherein enclosures are associated with a section wherein said cabs are being driven between the first and second floors.

9. The system as set forth in claim 8, wherein said enclosures are generally transparent.

10. The system as set forth in claim 1, wherein a motor for driving said rotating column is positioned adjacent a base of said column.

11. The system as set forth in claim 1, wherein said enclosed cab has sidewalls, a roof, and a floor, all moving with said cab.

12. A rotating passenger conveying system comprising:

a rotating central column being driven by a motor to rotate about a vertical axis and extending between a first and second floor;

at least six cabs being driven to rotate with said central column, and each of said cabs being separately, axially moveable along said axis to move between the first and second floors and being axially movable relative to said column; and at least one of said cabs at each of the floors at all times, and at least one of said cabs moving to each of the floors at all times, wherein a cycle of said cab movement being defined by said cab rotating once with said central column, and moving axially from said first floor to said second floor and then from said second floor to said first floor, all within one rotational cycle of said central column and said cabs.

13. A passenger conveying system comprising:

a drive for moving a plurality of cabs, each of said cabs having a floor, ceiling and side walls, through a cycle, with said cycle including movement of each of said cabs from an upper floor vertically downwardly to a lower floor, movement in a horizontal plane of said cab once at said lower floor for a period of said cycle, and movement back upwardly to an upper floor after said movement at said lower floor, with further movement of said cab horizontally without a vertical component at said upper floor; and said cabs being movable vertically relative to said drive for moving said cabs through said cycle, and said movement from said upper floor to said lower floor, said movement at said lower floor, said movement from said lower floor to said upper floor, and said movement at said upper floor all occurring within a single cycle.

14. A rotating passenger conveying system as recited in claim 13, wherein said drive is a rotating central column with said cabs rotating about said central column.

15. A rotating passenger conveying system as set forth in claim 14, wherein said cabs rotate with said column, but move axially relative to said column.

* * * * *